United States Patent [19]

Kindred

[11] 4,077,630

[45] Mar. 7, 1978

[54] BOARD GAME

[75] Inventor: Michael Kindred, Bilborough, England

[73] Assignee: Invicta Plastics Limited, Leicester, England

[21] Appl. No.: 750,854

[22] Filed: Dec. 15, 1976

[30] Foreign Application Priority Data

Dec. 23, 1975 United Kingdom ..... 52688/75

[51] Int. Cl.[2] ..... A63F 3/00

[52] U.S. Cl. ..... 273/273; 273/288

[58] Field of Search ..... 273/130 R, 130 G, 130 A, 273/135 AD, 135 R

[56] References Cited

U.S. PATENT DOCUMENTS

| | | | |
|---|---|---|---|
| 1,315,483 | 9/1919 | Edwards | 273/131 BB |
| 3,378,261 | 4/1968 | Schriber | 273/130 R |
| 3,583,706 | 6/1971 | Glass et al. | 273/135 R |

*Primary Examiner*—Richard C. Pinkham
*Assistant Examiner*—Arthur S. Rose
*Attorney, Agent, or Firm*—Diller, Brown, Ramik & Wight

[57] ABSTRACT

The board game of the invention provides a test of the logical thinking of two players. The board comprises nine playing areas on each of which the first player places a playing piece which he then covers with a shield. The second player has a number of test pieces which include the various characteristics of the playing pieces, with the exception of one characteristic, for example a representation of a treasure chest. By a process of deductive reasoning, the second player tries to locate the playing piece bearing the treasure chest, by first identifying at least some of the other pieces.

5 Claims, 3 Drawing Figures

BOARD GAME

BACKGROUND OF THE INVENTION

The invention relates to a board game for two players which has been devised to exercise their powers of deductive reasoning and logical thinking.

BRIEF SUMMARY OF THE INVENTION

The invention provides a board game comprising a board bearing a plurality of rows of playing areas positioned in a regular grid arrangement, a plurality of shield pieces corresponding in number to the number of playing areas, a plurality of playing pieces adapted to be partly concealed by said shield pieces and corresponding in number to the number of playing areas, said playing pieces each displaying one of a number of contrasting characteristics, one only of said pieces bearing a pre-selected characteristic, the location of at least the lone piece of said playing pieces when concealed by a shield piece being the task of one of said players, a number of test pieces bearing characteristics corresponding to said playing pieces with the exception of said pre-selected characteristic, and a plurality of marker pieces corresponding in number and characteristic to said playing pieces.

Advantageously the board game may also comprise further areas of the board which are defined for use in displaying playing pieces in a played condition; conveniently there are two such further areas, the first displaying those pieces which have been correctly played and therefore retained in the as-played position, the second those which have been incorrectly played and therefore removed from the as-played position.

In an example of the board game to be described in detail below there are nine playing areas arranged on a board in three regular rows of three. Nine shield pieces are arrangeable on the playing areas by a first player and these shield pieces conceal playing pieces from the view of the second player. The lone playing piece having the pre-selected characteristic is, in the present example, a piece representing a treasure chest and it is convenient if the playing areas are arranged on a representation of a desert island. Moreover, the remaining eight playing pieces bear characteristics relevant to sea-going piratical activity, two bearing, for example, a characteristic representing a rum barrel, two bearing a pair of crossed swords, two depicting the pirates' flag, the "Jolly Roger," and the remaining two showing a pistol. The second player is also provided with marker pieces bearing characteristics corresponding to the above so that as he identifies each concealed playing piece in accordance with the rules of the game he may mark the shield piece accordingly, irrespective of whether his identification is correct or not.

The aim of the second player is to identify the concealed playing pieces and therefore to locate the "treasure" by a process of elimination and logic.

BRIEF DESCRIPTION OF THE DRAWINGS

The rules of play will now be described with reference to the accompanying drawings which illustrate the board playing pieces, shield pieces and marker pieces by way of example only.

In the drawings.

DETAILED DESCRIPTION OF THE DRAWINGS

Figure 1:
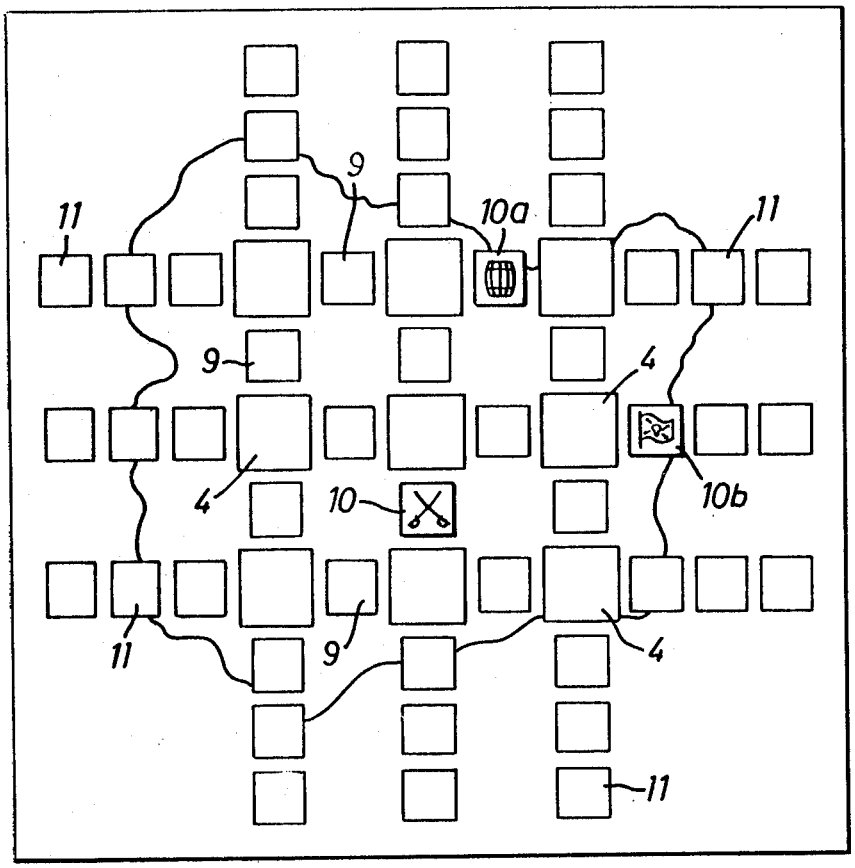
FIG. 1 shows the board with three test pieces.
Figure 2:
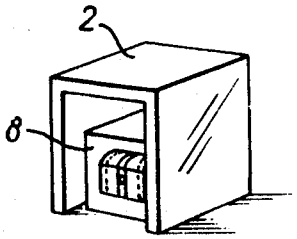
FIG. 2 shows a shield piece with the "treasure" playing piece partly concealed.

The first player places the nine shield pieces 2 on playing areas 4 of the board 6, so as to conceal nine playing pieces 8 from the view of the second player.

The second player then places one of his test pieces 10 on the board in a display area 9, between two adjacent playing areas 4. If either of the two adjacent playing areas is occupied by a playing piece corresponding in characteristic with that of the test piece, the test piece remains in position and is thus displayed as having been correctly played 10*a*. If neither corresponds, the first player removes the test piece towards the edge of the board to an adjacent one of a set of display areas 11, having been incorrectly played 10*b*. Once played, the test piece cannot be played again during that game.

Figure 3:
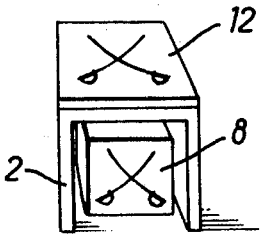
FIG. 3 shows a shield piece with a marker piece in position.

When the second player decides he has identified a concealed playing piece, he places a marker piece 12, in the form of a small tile, on the top of the shield piece (see FIG. 3).

When the second player has identified each concealed playing piece 8 and has decided which shield piece 2 conceals the "treasure" playing piece, he indicates this to the first player to finish the game. The first player then scores the attempts of the second player to place the marker pieces on the correct shield pieces, and gives a bonus score for the correct location of the "treasure" piece.

Various modifications may be made within the scope of the invention as defined in the following claims.

I claim:

1. In a board game for two players comprising a game board bearing a plurality of rows of playing areas positioned in a regular grid arrangement, a plurality of shield pieces corresponding in number to the number of playing areas, a plurality of playing pieces receivable in said shield pieces adapted to be concealed from one of the players by said shield pieces while remaining visible to the other player, the playing pieces corresponding in number to the number of playing areas, said playing pieces each displaying one of a plurality of contrasting characteristics, only one of said pieces bearing a preselected one of said characteristics, the location of at least said one only piece of said playing pieces when concealed by a respective shield piece being the task of said one player, a number of test pieces bearing characteristics corresponding to said playing pieces with the exception of said preselected one only playing piece, said game board having a plurality of test areas having different identifying characteristics from said playing areas, said test areas each disposed between a pair of adjacent ones of said playing areas in said regular grid to enable said one player to test for the presence of a playing piece having a particular characteristic by placing a test piece with that characteristic on a test area adjacent to that playing area, the number of test areas being greater than the number of playing areas, and a plurality of marker pieces corresponding in number and characteristics to all of said playing pieces for placement by said one player upon a respective shield piece to mark his reasoned selection as to the identity of that playing piece concealed by the respective shield piece.

2. A board game as claimed in claim 1, wherein the characteristic selected for the one only playing piece and not present among the test playing pieces is the representation of a treasure chest, the remaining characteristics being relevant to sea-going piratical activity.

3. A board game as defined in claim 1 wherein said board has further areas adjacent said playing areas for receiving and displaying incorrectly played test pieces removed from said test areas.

4. A board game as defined in claim 3 wherein said playing areas are arranged in rows and columns and said further areas are at the ends of said rows and columns.

5. A board game as defined in claim 1 wherein each shield piece is in the form of an enclosure of a size fully to receive one of said playing pieces, each shield piece including a supporting base and an open upstanding side through which the contrasting characteristic of an associated playing piece may be readily viewed by one player while remaining shielded relative to the other player.

* * * * *